United States Patent [19]

Hall

[11] Patent Number: 4,706,804

[45] Date of Patent: Nov. 17, 1987

[54] ARTICLE HANGER

[75] Inventor: David G. Hall, Akron, Ohio

[73] Assignee: Taylor Made Products Co., Akron, Ohio

[21] Appl. No.: 855,955

[22] Filed: Apr. 25, 1986

[51] Int. Cl.[4] ..... B65D 5/50

[52] U.S. Cl. ..... 206/45.14; 206/148; 206/485; 206/490; 206/806

[58] Field of Search ..... 206/147, 806, 45.14, 206/148, 485, 489, 490

[56] References Cited

U.S. PATENT DOCUMENTS

| | | | |
|---|---|---|---|
| 3,370,733 | 2/1968 | Giesler | 206/806 |
| 3,408,758 | 11/1968 | Doring | 206/806 |
| 3,881,601 | 5/1975 | Walus | 206/806 |

FOREIGN PATENT DOCUMENTS

| | | | |
|---|---|---|---|
| 2038764 | 7/1980 | United Kingdom | 206/147 |

*Primary Examiner*—Joseph Man-Fu Moy

*Attorney, Agent, or Firm*—Oldham, Oldham & Weber Co.

[57] ABSTRACT

A package is designed for a container having a raised bead ring on a top end and a dispensing valve within and protruding up from the ring; a cover cap for the dispensing valve and the bead ring. The package includes a support body made of cardboard foldable to make two layer structures having a pair of expand faces, a flat section and a support flange. The two layers of support flange contacts each other and is secured together. The support body and support flange have an aperture to receive the top end of the container.

7 Claims, 6 Drawing Figures

ARTICLE HANGER

BACKGROUND ART

Heretofore there have been many different types of hangers provided for articles so as to suspend them for display, sale or other purposes and one of these hangers is shown in U.S. Pat. No. 4,247,003 that has a product display card which has two article engaging portions formed in a cardboard portion thereof. One portion is folded out to make a flange section that is retained in engagement with the supported article by placing a top in engagement with the neck of the supported container to engage the supported article.

Additionally, U.S. Pat. No. 3,016,259 has a holder for engaging container necks to retain the container in position. The patent has a structure that has diametrically opposed edges that have rim-engaging cutouts that can flex outwardly under the thrust of the bottle or container into the unit until a rim flange thereon has moved past the support shoulders of the cutout edges.

Yet another type of a bottle-carrier structure is shown in U.S. Pat. No. 4,180,191 which has a cut-out present for engaging under flanges on the supported article.

However, in none of the prior art described hereinabove and that known to me, is there any type of a relatively uncomplicated, inexpensive, easily assembled, positive retention article hanger structure provided.

DISCLOSURE OF INVENTION

A cardboard hanger for an article comprising an elongate flat unit, having an article engaging aperture at one end of such unit partly defined by an end section thereof, the flat unit being split intermediate top and bottom surfaces thereof in the area thereof forming the article engaging aperture to form top and bottom layers adapted to be pivoted out of the plane of the flat unit to form an article support layer extending perpendicular to the plane of the flat unit.

The invention further relates to an improved combination comprising a container having a bead on its upper end and a dispensing valve protruding upwardly from the top end of the container, and a cover cap for the bead that combines with a paperboard support body for the supported article, such support body has an article engaging aperture therein and a support flange at its lower end for engaging under the bead of the article and for being retained in position by the lower end of the cap engaging the bead and extending down to press against the edge portions of the support flange to retain the paperboard hanger and container in suspended operative engagement.

The present invention has as its general object the provision of a novel and improved article support hanger, usually made from paper board and which is adapted to be readily engaged an article having a cover, or cap, provided on the upper end thereof in removable engagement with a retainer bead on the container whereby the cardboard unit, which has a support flange extending perpendicularly from its lower end, can be engaged with the container underneath the bead and cover cap and to be engaged therewith.

Another object of the invention is to provide a cardboard or paper type of hanger structure that can be formed from one ply of cardboard and can be folded upon itself to provide a two-ply cardboard support with a desired article engaging aperture provided therein and formed partially in an end portion of the support hanger.

It is yet another object of the invention to provide a cardboard article hanger which has a support flange formed on its lower end and extending perpendicularly therefrom, which support flange has a reinforcing layer on its lower surface to aid in engaging the hanger with an article and retaining it in an effective display position.

The foregoing and other objects and advantages of the present invention will be made more apparent as the specification proceeds.

BRIEF DESCRIPTION OF DRAWINGS

Attention is now particularly directed to the accompanying drawings wherein.

When referring to corresponding members shown in the drawing and referred to in the specification, corresponding numerals are used to facilitate comparison therebetween.

BEST MODE FOR CARRYING OUT INVENTION

Figure 1:
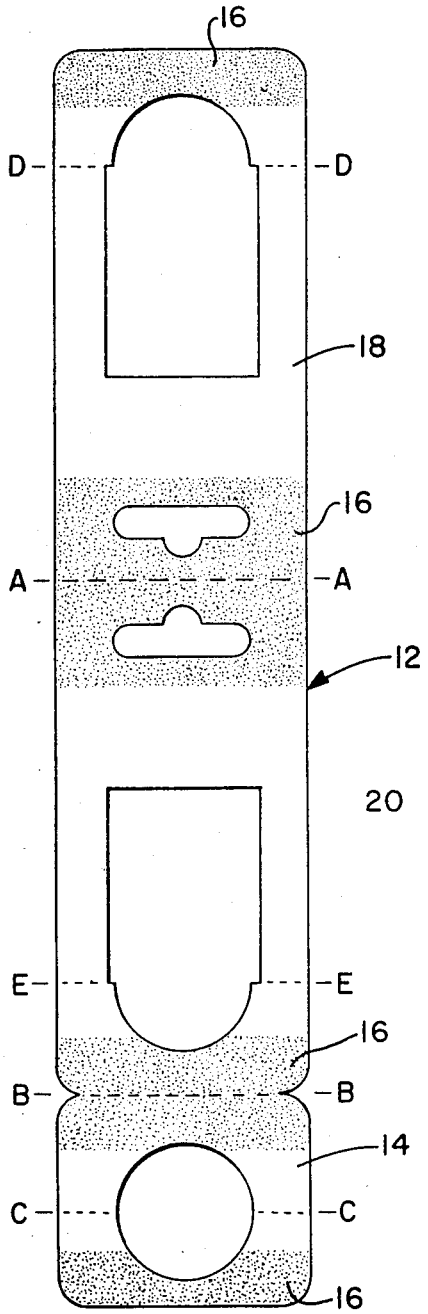
FIG. 1 is a plan view of a blank from which a support hanger embodying the principles of the invention can be formed.

FIG. 1 of the drawings shows an elongated blank 12, normally formed of a paper board such as cardboard, and wherein the blank 12 is used for forming a cardboard hanger 10 of the invention. The blank 12 has a plurality of scored fold lines A—A, B—B, C—C, D—D, and E—E formed therein whereby this blank can be folded at the score line A—A to form a flat support unit that has a reinforcing layer 14 provided thereon by the fold or score line B—B. The blank 12 can be made from any suitable material such as 0.018" gauge SBS cardboard.

Any suitable adhesive can be applied to desired areas of one surface of this cardboard blank 12 as indicated at the dotted areas 16 thereof in FIG. 1 so that various portions of the blank will be secured together. Hence the blank is folded upon itself to provide an elongate flat unit having one outer surface or section 18 and a second outer surface layer 20 on the cardboard hanger 10. By folding the flaps formed by the lines D—D and E—E outwardly, and then folding the section 14 back on the adjacent parts of the blank, one provides a support layer or flange indicated at 22 which is formed in the cardboard hanger 10, and extends perpendicularly from the main flat portion of the hanger.

Figure 2:
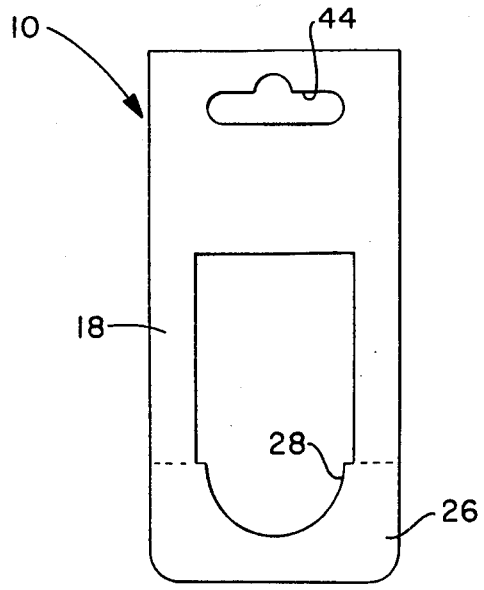
FIG. 2 is a plan view of a support hanger or article of the invention.
Figure 3:
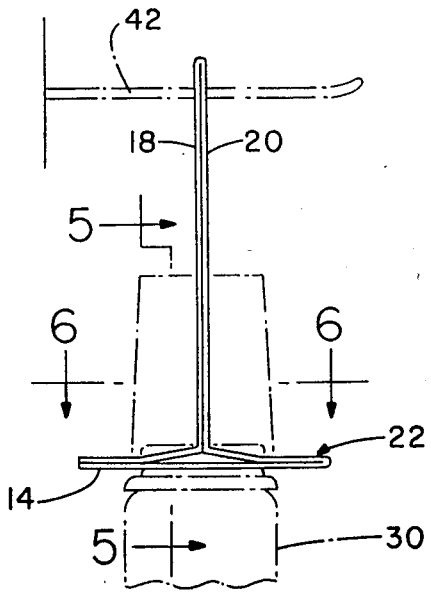
FIG. 3 is side elevation of the support hanger of the invention with an article supported thereby shown in phantom lines.
Figure 4:
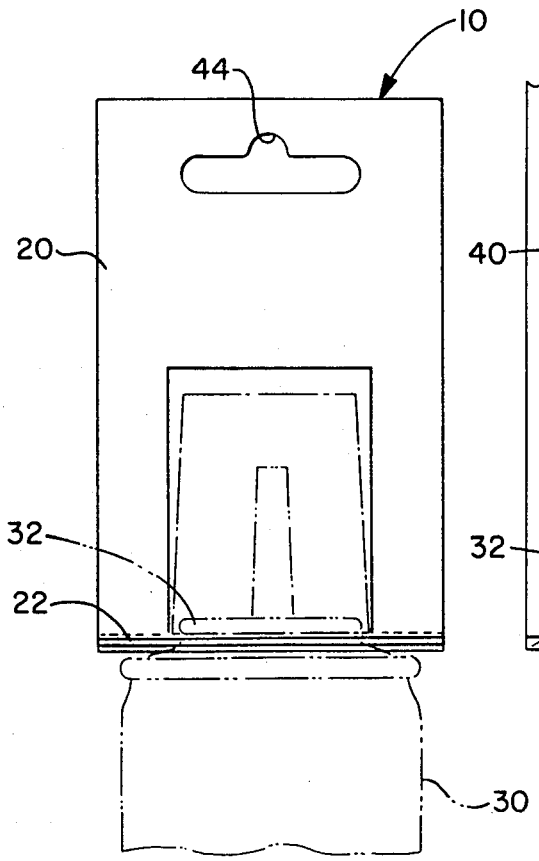
FIG. 4 is a front elevation of the hanger and article combination of FIG. 3.
Figure 5:
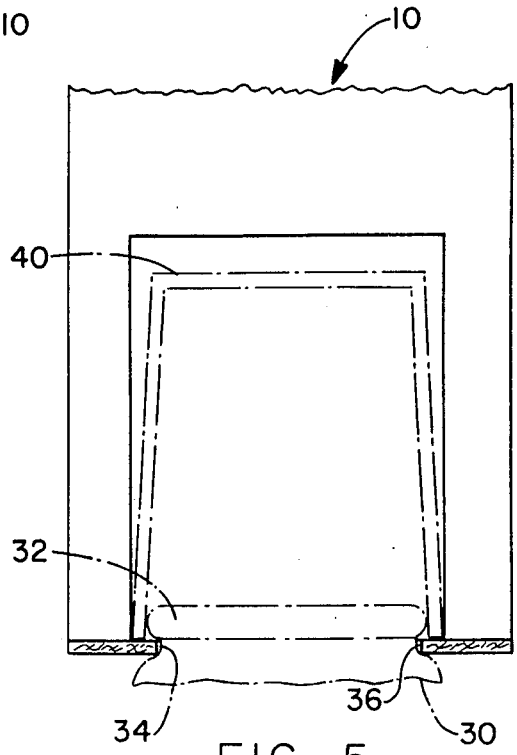
FIG. 5 is a fragmentary vertical section on line 5—5 of FIG. 3.
Figure 6:
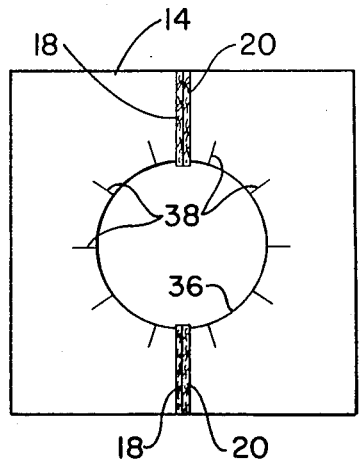
FIG. 6 is a section on line 6—6 of FIG. 3.

When the portions or plies of the blank 12 are folded to flat condition as shown in FIG. 2, then the lower portion of the cardboard hanger has an end section 26 provided thereon at the lower end of an article receiving aperture 28 formed in the cardboard hanger 10. The aperture 28 is provided for engaging with a supported article as hereinafter described in more detail.

In making up the operative cardboard hanger 10, the reinforcing layer 14 has a center fold at the scored line C—C provided therein and this reinforcing layer is then suitably cemented or secured to the adjacent end flaps on the blank and provided by the scored lines D—D and E—E so that the reinforcing layer 14 can be flattened upon itself, as shown in FIG. 2, or else it can be folded out to extend at substantially right angled relationship to the plane defined by the main body or flat section of the cardboard hanger 10.

In order to position the hanger operatively and to support a container 30 thereby, one first provides a container 30 that has a bead or rim 32 on its upper end and this bead normally has a recess 34 under its lower surface.

A specific container neck engaging aperture 36 is formed in this reinforcing layer 14 and the support flanges 22 which are suitably secured together. It is sized so as to be resiliently received or engaged under the recess 34 on the container bead 32. Snug, resilient engagement of the reinforcing and support layers with the supported article is facilitated by cutting a plurality, such as ten, short radially extending slits 38 in such layers at the aperture 36. This bead 32 resiliently secures the container 30 to the cardboard hanger 10 whereas final and positive engagement is reinforced between the cardboard hanger and the container by means of a cap or cover 38 that frictionally engages the bead 32. The cap 38 extends down past the bead and bears on the edge portions of the aperture 36 in the reinforcing layer 14. The cap hence aids in obtaining a good but releasable engagement between the container 30 and the cardboard hanger whereby when the cardboard hanger 10, for example, is attached to a support hook 40 as by an aperture 42 provided in an upper end of the cardboard hanger, the article or container 30 will be readily and nicely displayed from the hanger and be suspended therefrom. However, when one desires to purchase the article, the unit can just be slipped from the hanger 40 and then, when desired, the cardboard hanger 10 can be pulled from engagement with the container. The cap 38 may be removed from the container, if desired, to facilitate springing the reinforcing layer 14 out of engagement with the container 30.

From the foregoing, it will be seen that a relatively inexpensive, uncomplicated cardboard hanger has been provided for use in combination with a container for displaying the container neatly and attractively for sales purposes. These cardboard hangers are relatively inexpensive and can be made in large numbers at low cost and yet they will provide a serviceable, strong, operative article. Hence, the objects of the invention have been achieved.

While in accordance with the patent statutes, a preferred embodiment and best mode has been presented, the scope of the invention is not limited thereto, but rather is measured by the scope of the attached claims.

What is claimed is:

1. In combination, a container having a raised bead ring on a top end thereof and a dispensing valve within and protruding up from said ring;

a cover cap for said dispensing valve and bead ring; and a support body formed of a continuous elongate strip of cardboard folded to make a two layer structure having a pair of exposed faces and having a flat section and a support flange that extends normally from both of said faces of said flat section at one end thereof, the two layers of said support flange contacting each other and being secured together, said support body and support flange having an article receiving aperture formed therein which receives the top end of said container therein with said support flange lying in close proximity to and below said ring, said bead ring being snuggly engaged by said support flange, said cover cap engaging said bead and bearing on said support flange to aid in retaining said container and support body in assembled relation.

2. A combination as in claim 1 where the combination is adapted to be suspended from a hanger, and said cover cap is received in said article receiving aperture and said container is below said support flange.

3. A combination as in claim 1 where the peripheral portions of said support flange at said article receiving aperture have a plurality of short generally radially extending slits therein to aid in providing resiliency in said support flange for obtaining snug engagement of said support flange with said bead ring for support of said container.

4. A hanger for an article comprising an elongate flat unit formed of cardboard and having a support aperture adjacent one end thereof and an article engaging aperture at the other end of such unit partly defined by an end section of said flat unit, said flat unit being primarily made of two layers of cardboard having top and bottom surfaces, said flat unit being split intermediate the top and bottom surfaces thereof at one end, the split in said flat unit forming top and bottom layers therein that are in contact and are secured together for at least part of said lengths, said top and bottom layers being adapted to be pivoted out of the plane of the remainder of said flat unit to aid in forming a support layer extending perpendicular to the plane of said flat unit.

5. A cardboard hanger for an article comprising a unit formed from an elongate strip of cardboard and including two layers of cardboard forming a flat support strip having an article engaging aperture at one end of such unit partly defined by end sections of said layers, and a two-layer reinforcing portion primarily formed from an end portion of one layer of said support strip which is affixed to initially opposed inner surfaces of lengths of said end sections, the two layers of said reinforcing portion abutting and extending perpendicular to said flat support strip, said reinforcing portion having an aperture therein forming part of and connecting to said article engaging aperture, said reinforcing portion extending perpendicular to the plane of said flat unit to form an article engaging support layer with said lengths of said end sections to which it is secured.

6. A cardboard hanger as in claim 5 where substantially 180° of an arcuate aperture is formed in said lengths of said end section and a diameter of such aperture connects to said article engaging aperture, and said lengths of said end sections form an article neck engaging aperture, and said end portion of one layer of said support strip having an article neck engaging aperture therein aligned with said first named article neck engaging aperture.

7. A cardboard hanger as in claim 5 where said two layers of said support strip are secured together by being adhesively bonded to said end portions of said length of said end sections.

* * * * *